United States Patent [19]

Jung et al.

[11] 4,303,453

[45] Dec. 1, 1981

[54] METHOD AND APPARATUS FOR REMOVING SAND FROM CASTINGS

[75] Inventors: Werner Jung, Zurich; Jack Oswald, St. Gallen, both of Switzerland

[73] Assignee: Foundry Design Corp., St. Gallen, Switzerland

[21] Appl. No.: 126,599

[22] Filed: Mar. 3, 1980

[30] Foreign Application Priority Data

Jun. 6, 1979 [CH] Switzerland ..... 5259/79

[51] Int. Cl.[3] ..... B08B 3/02; B08B 7/04

[52] U.S. Cl. ..... 134/10; 134/25.1; 134/109; 164/5

[58] Field of Search ..... 134/10, 25.1, 13, 104, 134/109, 111; 164/5; 209/17, 211; 210/512 R, 512.1

[56] References Cited

U.S. PATENT DOCUMENTS

| | | | |
|---|---|---|---|
| 2,331,102 | 10/1943 | Bird | 164/5 X |
| 2,783,511 | 3/1957 | Will et al. | 164/5 X |
| 2,784,468 | 3/1957 | Booth et al. | 164/5 |
| 3,147,212 | 9/1964 | Koppen et al. | 134/25.1 X |
| 3,446,349 | 5/1969 | Benzon | 209/17 |
| 4,070,274 | 1/1978 | Bryson | 209/17 X |
| 4,133,747 | 1/1979 | Visman | 209/17 X |
| 4,144,088 | 3/1979 | Adams | 134/25.1 X |
| 4,260,009 | 4/1981 | Noble | 164/5 X |

FOREIGN PATENT DOCUMENTS

| | | | |
|---|---|---|---|
| 51-22621 | 2/1976 | Japan | 164/5 |

*Primary Examiner*—Marc L. Caroff

*Attorney, Agent, or Firm*—Blanchard, Flynn, Thiel, Boutell & Tanis

[57] ABSTRACT

In a hydro-jet housing the form block, possibly with core, is stripped of mold sand by means of a high-pressure water jet. The sand is fed in the form of a muddy pulp to a first hydrocyclone, where the water is largely separated and is supplied for the formation of new muddy pulp. The sand flows into a scrubbing mechanism for knocking off its binding material, which has settled as a coat around the sand grains. After being scrubbed, the sand is fed to a second hydrocyclone for hydro-extracting water and dislodged binding material from the sand. The sand is then dried and cooled and is available for further use. The contaminated water is neutralized with flue gas, after which a flocculation agent is added to it and the water is then purified for reuse in a settling tank and possibly in a filter.

12 Claims, 2 Drawing Figures

1
2
3
4
5
6
6A
7
8
9
10
11
12
12A
12B
13
14
15
16
17A
17B
18
19
20
21
22
23
24
25
30
90
92
150
190

30
31
32
40
41
42
43
44
45
46
50
51
52
53
54
54
60
61
62
70
71
80
81
90
91
92
M

METHOD AND APPARATUS FOR REMOVING SAND FROM CASTINGS

FIELD OF THE INVENTION

The invention relates to a method for the wet desanding and cleaning of castings from mold blocks using one-time molds and for the reclamation of the sand and possibly recovery of the water, and an apparatus for performing the method.

BACKGROUND OF THE INVENTION

During sand casting, or stripping of the mold by means of a pressure water jet, there exists on the one hand the problem of providing a rational mode of operation and on the other hand achieving optimum economy with respect to the utilization of the auxiliary materials, namely, the sand and water. High-grade and, therefore, expensive sand is partly used. The water jet action requires much water, which cannot be discharged without first having been cleaned.

The goal of the invention is to increase the economy of sand molding and stripping by making the sand and water reusable, which practically results in a closed material cycle.

This is achieved in the above-mentioned method by inventively reclaiming both the sand and the water. If a special sand, for example quartz or zircon sand is used, to which is admixed a binding material, for example, cold resin or sodium silicate solution (water glass), then the method comprises

- washing the entire form block by exposing same in a water jet enclosure to a high-pressure water jet,
- flushing out the muddy pulp and separating the green sand and water in a first water separator,
- guiding the green sand into a chamber having an agitator, in which the binding material which adheres to the sand is separated from the sand by rubbing the sand grains on one another,
- supplying the separated water to a water cleaning process for the sand to be used to make a new mold,
- the molding sand and water being ultimately separated in a second water separation and/or an oscillatory or rotating water separator or a filter press.

Expanding the method, it is possible on the one hand

- to dry the sand, to cool it and supply it for reuse, and on the other hand
- to neutralize the water, possibly with the addition of $CO_2$, supplied in the form of flue gas,
- to add to the water a flocculation agent, for example, ferric chloride, aluminum sulfate or the like or a flocculation auxiliary means, for example, a polyelectrolyte, and
- to clean it in a settling tank until it can again be used for loosening the sand in the jet housing.

To carry out the method, an apparatus is used which is inventively characterized by the series connection of

- a hydro-jet housing,
- possibly a magnetic metal separator and a crusher for sand chunks,
- a first hydrocyclone for separating a large portion of the water from the muddy pulp,
- a rubbing mechanism for the sand,
- a washing container for the rubbed sand,
- a second hydrocyclone for separating a large portion of the water from the new muddy pulp, wherein from this hydrocyclone extends a return pipeline for the separated water to the washing container,
- a rotating or oscillatory water separator or a filter press, after which is connected a sand-drying and sand-cooling mechanism.

Thus, the reuse of sand and water is of a great advantage. The economical advantage can already be seen in a medium-sized installation using with a sand turnover of 10 t. sand and a water consumption of 8 $m^3$, per hour.

BRIEF DESCRIPTION OF THE DRAWINGS

The attached drawings schematically illustrate one exemplary embodiment of an installation for the wet desanding of a form block and for the reclamation of sand and water for reuse.

DETAILED DESCRIPTION

Figure 1:
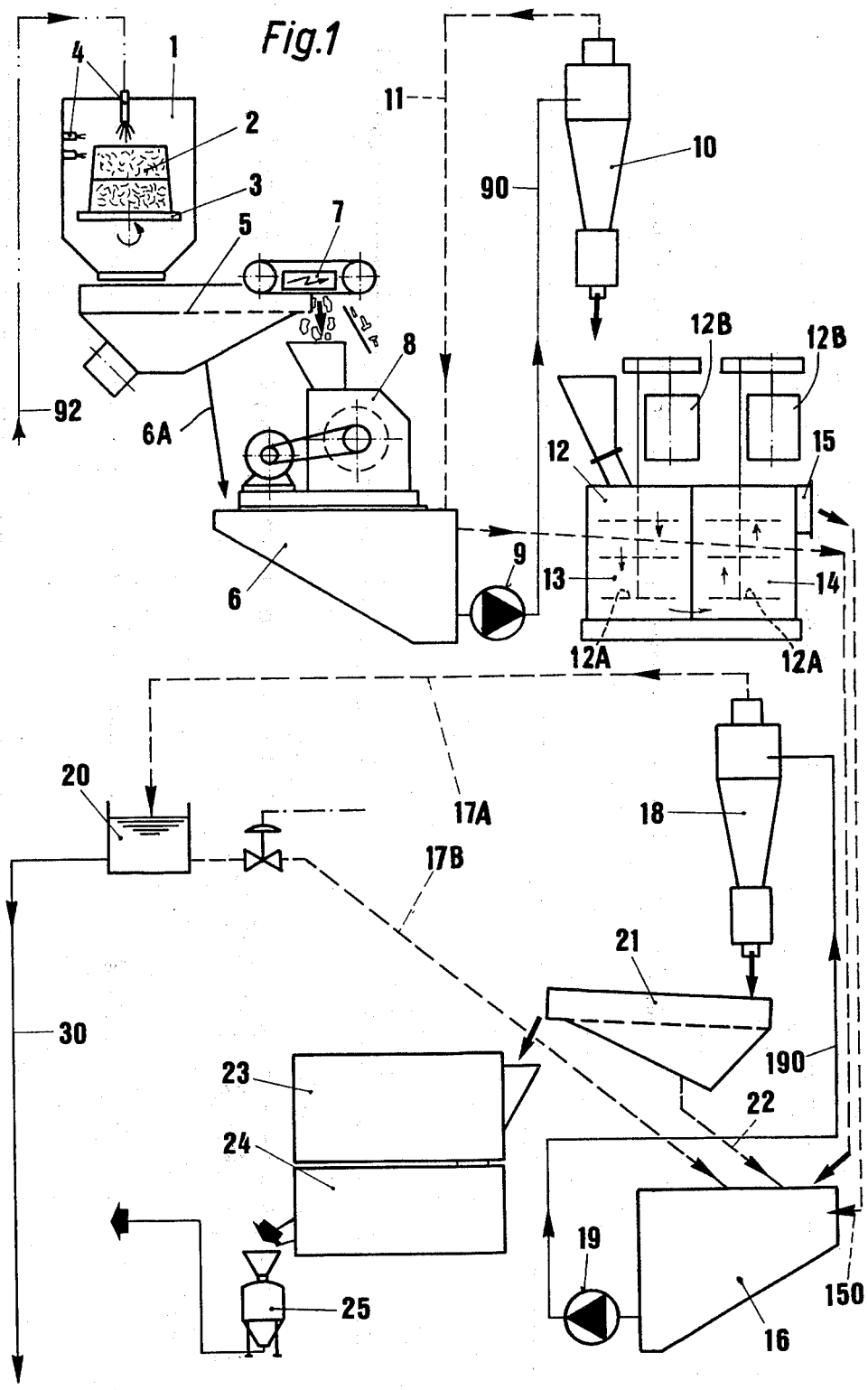
FIG. 1 illustrates the stripping of the mold and the reclamation of the sand.

The hereinafter listed figures represent the most economical values for a certain case. They are less well suited for other cases, however, they lie within the scope of the invention disclosed herein.

Reference numeral 1 identifies the cleaning or hydro-jet housing, inside of which the cast form block 2, namely, the casting with the mold sand thereon, is housed on a preferably rotatable table or grate 3. Water jet nozzles 4 are arranged on the inner walls of the housing, which nozzles are directed toward the table. It is preferable that these nozzles be swivelably mounted on the inside wall of the housing. The positions of the jet nozzles can be controlled from outside the housing. In a modified embodiment, it is possible to move the jet nozzles which are arranged on the side walls up and down together, so that the entire form block is contacted with the water jets from the nozzles and the sand is washed off the casting and broken up by the blast of water into sand chunks.

The nozzles in the hydro-jet housing operate with a water pressure of 450 bar. Same can reach, depending on the sand and the mold, up to 800 bar, preferably, however, in the range of 350 to 700 bar.

The loosened sand falls with the water and the metal flash from the casting onto the finely perforated separating conveyor trough, slide or belt 5, where they are guided beneath a magnetic separator 7 to separate the metal flash from the sand. The loosened sand chunks which are too large to fall through the perforations in the trough 5 travel through a crusher 8 into a first intermediate container 6. The remainder of the sand chunks small enough to fall through the perforations in the trough 5 slide along a schematically illustrated slide 6A directly into the first intermediate container 6.

In the described example, 25 blocks of 40×40×50 cm. are formed, which results in a pressure water accumulation of 2 $m^3$/h. and a sand accumulation of 2.6 t/h. The sand is mixed in the intermediate container 6 by admixing 21.9 $m^3$/h. of water from a first hydrocyclone 10 to form a sand pulp or sand-water slurry.

The sand-water slurry is fed by a pump 9 from the intermediate container 6 into a pipeline 90 to the first hydrocyclone 10, from where the separated water (approximately 21.9 $m^3$/h.) travels through the return pipeline 11 to the first intermediate container 6.

The hydro-extracted green sand 2.6 t/h. and 1.1 $m^3$/h. water fall into the first of two octagon chambers of a conventional scrubbing mechanism 12. Each chamber has an agitator 12A driven by a drive motor 12B, wherein the agitator of the first chamber 13 delays the settling process of the sand and the agitator of the second chamber 14 directs the sand through a connection 15 to a pipeline 150 which extends to and is connected to a second intermediate container 16. Due to the intensive turbulence in the chambers of the scrubbing mechanism 12, the grains of sand are rubbed against one another, so that the water-glass coating flakes off. The passage of sand grains through the rubbing mechanism 12 takes from 4 to 6 min. The output of the rubbing mechanism 12 is, in the described example, 2.6 t/h. of sand in 1.1 $m^3$/h. of water. The rubbed-off coating parts or flakes are carried along by the water and arrive with the water at the water reclamation system.

For the further processing of the sand, the second intermediate container 16 receives 21.9 $m^3$/h of water from a second hydrocyclone 18 through a pipeline 17A and 17B, so that a pump 19 connected to the outlet of the second intermediate container 16 conveys, per hour, a muddy pulp of 2.6 t. sand mixed with 23 $m^3$ water through a pipeline 190 to the second hydrocyclone 18. The separated water is fed to a basin 20, from where it is conducted partly into the aforesaid second intermediate container 16 through the pipeline 17B and partly to the water reclamation process (FIG. 2) through the pipeline 30.

The sand from the second hydrocyclone 18 flows as green sand (2.6 t/h. sand and 1.1 $m^3$/h. water) into an oscillatory water separator 21 (vibratory screen), from where 0.55 $m^3$/h. water is removed from the sand. The 0.55 $m^3$/h. water flows through the pipeline 22 into the intermediate container 16. The separated sand, however, is dried in the driers 23 and 24, is cooled and is fed to a storage reserve silo 25 and thence to a pneumatic sand transmission device as reclaimed sand useful for the manufacture of new molds. The drying of the wet sand occurs by means of oil or natural gas heat and a subsequent cooling to minus 35° C.

The numerical values which are given in the example are valid—as already mentioned—only for this example. The slurry in the first intermediate container 6 and in the second intermediate container 16 has a mixing relationship of between 1 t. sand and 7 $m^3$ water, up to 1 t. sand and 10 $m^3$ water. The wet-reclaimed sand contains from 2 to 15% water.

The individually illustrated and described structural elements can be replaced with other structural elements, assuming they fulfill the same function. For example, it is possible to use in place of the oscillatory screen 21 also a rotating water separator (centrifuge) or a filter press. The hydrocyclones 10 and 18 can operate at atmospheric pressure or below atmospheric pressure.

Figure 2:
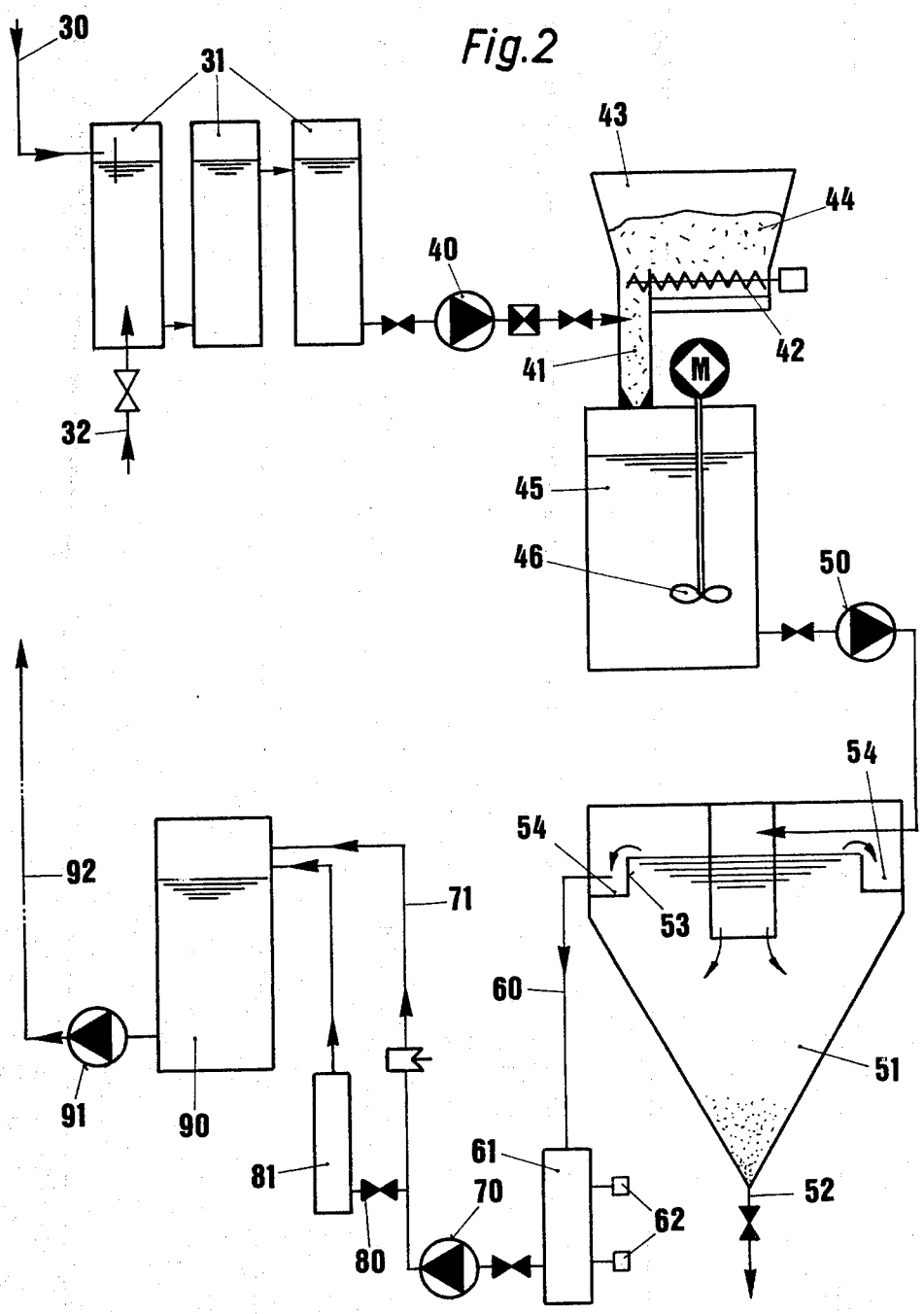
FIG. 2 illustrates the reclamation of the jet water and the water which is used for the reclamation of the sand.

The water reclamation system according to FIG. 2 functions to reclaim the excess water accumulated in the basin 20 (FIG. 1), from the water jet housing 1, the first intermediate container 6, the second intermediate container 16 and the second hydrocyclone 18. The water is alkaline due to the soda which is added to the sand and flows to a neutralization chamber 31 via the pipeline 30, where it is neutralized in a counterflow with $CO_2$ in the form of flue gas introduced therein through the pipe 32. The flue gas from the drying process of the sand can thereby be used. The water then flows through the first dosing pump 40 into the treatment chamber 41 of a storage container 43 for mixture with a flocculation agent 44. The storage container 43 is provided with a worm conveyor 42. Water and flocculation agent flows into a reaction receptacle 45, in which an intensive mixing takes place by an agitator 46.

The mixture is guided to a settling tank 51 through the second dosing pump 50, from where the settled flocculated solids are removed through an outlet 52, while the clarified water flows over the weirs 53 into an overflow channel 54 and a pipeline 60 to an intermediate reservoir 61. Liquid level probes 62 are arranged on the intermediate reservoir and are used to measure the degree of pureness of the water and to control the dosing pumps 40,50,70.

The clean water can be forwarded directly through a pipeline 71 or a valve 80 and a filter 81 to a water reservoir 90 for supplying a high pressure water pump 91. The filter 81 is installed as a safety device in order that no suspended substances which will damage the high pressure pump 91 and/or the high pressure nozzles 4 (FIG. 1) reach these parts. Suspended substances having a minimum size of 5 to 15$\mu$ are normally held back.

In place of the flocculation agent 44, for example, ferric chloride or aluminum sulfate or additionally thereto, it is possible to admix a flocculation auxiliary agent, for example a polyelectrolyte.

Of course, fresh water can be added during each step of the entire system. However, it is remarked that over 85% of the water used can be reclaimed and can either be discharged as clean waste water or can be reused for stripping of the mold.

The entire described system is particularly suited for removing of cores and mold sand, thus one-time molds, in which a quartz sand, zircon sand or the like are used, to which a binding material, for example cold resin, sodium-silicate solution (water glass) is admixed.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A method for desanding a casting using high pressure water and separately recovering cleaned sand and cleaned water, wherein said casting has been prepared by sand casting using a mold made of quartz sand or zircon sand coated with a binder of resin or sodium silicate, said casting containing adhering thereto mold sand residues consisting essentially of said sand and said binder, which comprises the steps of: directing one or more high pressure water jets against said casting to dislodge said mold sand residues therefrom and separating a pulp consisting essentially of particles of said mold sand residues mixed with water; then, in a first separation step, mixing said pulp with a first additional quantity of water to form a slurry and then separating said first additional quantity of water from said slurry in a first hydrocyclone to obtain a hydro-extracted pulp; then feeding said hydro-extracted pulp into a scrubber and therein subjecting said hydro-extracted pulp to intensive turbulence and thereby rubbing said particles against one another so that said binder flakes off from the sand grains, and removing from the scrubber a mixture of said sand grains, binder flakes and water; then, in a second separation step, mixing said mixture with a second additional quantity of water and then separating a first fraction containing a major quantity of the water and the binder flakes from a second fraction containing a minor quantity of water and said sand grains in a second hydrocyclone; then removing water in the second fraction from said sand grains and then drying and cooling said sand grains to recover cleaned sand; neutralizing said first fraction by contacting same with gas containing $CO_2$; then adding and mixing a flocculation agent with said first fraction to flocculate the solids contained in said first fraction; separating the flocculated solids from the water and thereby recovering cleaned water from the first fraction.

2. A method according to claim 1, wherein the water removed at the upper end of said first hydrocyclone is used as said first additional quantity of water that is mixed with said pulp; and, in the second separation step, a portion of said first fraction is used as said second additional quantity of water that is mixed with said mixture.

3. A method according to claim 1, in which said high pressure water jet has a water pressure of from 350 to 800 bars.

4. A method according to claim 2, in which, in the first separation step, said first additional quantity of water discharged from said first hydrocyclone is mixed with said pulp in a first intermediate container so that said slurry fed to said first hydrocyclone contains from 7 $m^3$ to 10 $m^3$ of water per 1 ton of sand.

5. A method according to claim 2, in which, in said second separation step, said portion of said first fraction discharged from said second hydrocyclone is mixed with said mixture in a second intermediate container so that said mixture fed to said second hydrocyclone contains from 7 $m^3$ to 10 $m^3$ of water per 1 ton of sand.

6. A method according to claim 1 in which the cleaned sand contains from 2 to 15% of water.

7. A method according to claim 1 in which the sand is dried by heating it with the gaseous combustion product obtained by burning a fuel and then said gaseous combustion product is used as said gas containing $CO_2$ to neutralize said first fraction.

8. An apparatus for the desanding of sand castings and separately recovering cleaned sand and cleaned water, which comprises: a hydro-jet housing for receiving the sand castings and including jet means for jetting high pressure water against said castings to dislodge mold sand residues therefrom to form a muddy pulp, said mold sand residues comprising sand grains having binder adhering thereto; a magnetic metal separator for removing magnetizable metal from said pulp; a crusher for crushing large size chunks of said mold sand residues in said pulp; first mixing means for mixing said pulp with a first additional quantity of water to form a first pumpable slurry; a first pump for pressurizing said first slurry; a first hydrocyclone for receiving said pressurized first slurry from said pump and separating said pressurized first slurry into an overflow first fraction comprised of a major proportion of water in said first slurry and an underflow second fraction comprised of the mold sand residues and the remainder of the water in said first slurry; first conduit means for returning said first fraction to said first mixing means to serve as said first additional quantity of water supplied therein; a scrubber for receiving said second fraction from said first hydrocyclone and subjecting said second fraction to intensive turbulence to rub said mold sand residues against one another so that said binder flakes off said sand grains; a washing container for receiving said second fraction from said scrubber and including means for adding a second additional quantity of water to said second fraction to form a second pumpable slurry; a second pump for pressurizing said second slurry; a second hydrocyclone for receiving said pressurized second slurry from said second pump and separating said pressurized second slurry into an overflow third fraction comprised of a major proportion of water and the binder flakes in said second slurry and an underflow fourth fraction comprised of the sand grains and the remainder of the water; second conduit means for returning a portion of said third fraction to said washing container as said second additional quantity of water supplied therein; means for separating water from said fourth fraction to dewater the sand grains and means for drying and cooling said sand grains to recover cleaned sand; contactor means for receiving the remainder of said third fraction, said contactor means including means to contact said remainder of said third fraction with gas containing $CO_2$; a flocculation apparatus including means for supplying and mixing a flocculating agent with the neutralized remainder of said third fraction; and means for separating flocculated solids from the water in the neutralized remainder of said third fraction whereby to recover cleaned water.

9. An apparatus according to claim 8 wherein said jet means comprises water jet nozzles mounted on said hydro-jet housing for swinging movement and for up and down movement on said hydro-jet housing.

10. An apparatus according to claim 8 wherein said first mixing means is a first intermediate container positioned between said crusher and said first pump for receiving said muddy pulp from said crusher and said first additional quantity of water from said first hydrocyclone.

11. An apparatus according to claim 8 in which said flocculation apparatus includes a first dosing pump for feeding the neutralized remainder of said third fraction into a storage container, means for feeding flocculation agent into said storage container, an agitator in said storage container for mixing the flocculation agent with said neutralized remainder of said third fraction, and a settling tank for allowing the flocculated solids to settle to separate same from the water.

12. An apparatus according to claim 8 or claim 11 including a filter for filtering solids from the water that has been separated from the flocculated solids.

* * * * *

UNITED STATES PATENT AND TRADEMARK OFFICE

CERTIFICATE OF CORRECTION

PATENT NO. : 4 303 453

DATED : December 1, 1981

INVENTOR(S) : Werner Jung and Jack Oswald

It is certified that error appears in the above—identified patent and that said Letters Patent is hereby corrected as shown below:

On the title page change Item [73] Assignee: to read

---Foundry Design Corp. (Europe), Rapperswil, Switzerland---.

On the title page Item [76]

Please change the address of inventor Werner Jung to

---Hombrechtikon, Switzerland---.

On the title page Item [76]

Please change the address of inventor Jack Oswald to

---Jona, Switzerland---.

Signed and Sealed this

*Seventh* Day of *September 1982*

[SEAL]

*Attest:*

GERALD J. MOSSINGHOFF

*Attesting Officer*

*Commissioner of Patents and Trademarks*